US011097169B2

(12) United States Patent
Wei et al.

(10) Patent No.: US 11,097,169 B2
(45) Date of Patent: Aug. 24, 2021

(54) AMORPHOUS ALLOY GOLF CLUB HEAD AND MANUFACTURING METHOD THEREOF

(71) Applicant: NANJING YOUTIAN METAL TECHNOLOGY CO., LTD., Nanjing (CN)

(72) Inventors: Jie Wei, Nanjing (CN); Hui Ye, Nanjing (CN)

(73) Assignee: NANJING YOUTIAN METAL TECHNOLOGY CO., LTD., Nanjing (CN)

( * ) Notice: Subject to any disclaimer, the term of this patent is extended or adjusted under 35 U.S.C. 154(b) by 0 days.

(21) Appl. No.: 16/960,097

(22) PCT Filed: Aug. 20, 2019

(86) PCT No.: PCT/CN2019/101570

§ 371 (c)(1),
(2) Date: Jul. 6, 2020

(87) PCT Pub. No.: WO2020/042967

PCT Pub. Date: Mar. 5, 2020

(65) Prior Publication Data

US 2021/0046365 A1 Feb. 18, 2021

(30) Foreign Application Priority Data

Aug. 27, 2018 (CN) ..... 201810980343.7
Aug. 6, 2019 (CN) ..... 201910720914.8

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/047* (2013.01); *A63B 53/08* (2013.01);
(Continued)

(58) Field of Classification Search
CPC ..... A63B 53/06; A63B 53/047; A63B 53/08; A63B 2053/0491; A63B 2209/00; B22D 17/2218; B22D 19/00
(Continued)

(56) References Cited

U.S. PATENT DOCUMENTS 2,332,342 A * 10/1943 Reach ..... A63B 53/047 473/248
4,558,505 A * 12/1985 Moore ..... B22C 9/04 164/112
(Continued)

FOREIGN PATENT DOCUMENTS

CN 1816374 A 8/2006
CN 1925892 A 3/2007
(Continued)

*Primary Examiner* — Sebastiano Passaniti
(74) *Attorney, Agent, or Firm* — Bayramoglu Law Offices LLC

(57) ABSTRACT

The amorphous alloy golf club head is integrally casted from an amorphous metal material, and includes a neck, a hitting panel, a peripheral wall, a cushion block and an adjusting member. The neck is configured for combination with a club; the hitting panel is connected to the bottom of the neck; the peripheral wall is located on a rear surface of the hitting panel, the peripheral wall forms a rear concave cavity with the hitting panel; the cushion block is embedded in the peripheral wall to reduce the casting thickness of the peripheral wall, and provided with a plurality of pillars thereon, wherein one end of each pillar is fixedly connected to the cushion block body, and the other end of the pillar has an exposed surface or exposed section not covered by the
(Continued)

peripheral wall; and the adjusting member is matingly connected to the pillar.

14 Claims, 4 Drawing Sheets

(51) Int. Cl.
*A63B 53/08* (2015.01)
*B22D 17/22* (2006.01)
*B22D 19/00* (2006.01)

(52) U.S. Cl.
CPC ..... *B22D 17/2218* (2013.01); *B22D 19/00* (2013.01); *A63B 2053/0491* (2013.01); *A63B 2209/00* (2013.01)

(58) Field of Classification Search
USPC ..... 473/324–350, 287–292
See application file for complete search history.

(56) References Cited

U.S. PATENT DOCUMENTS 4,708,347 A * 11/1987 Kobayashi ..... A63B 53/047 473/338
5,398,746 A * 3/1995 Igarashi ..... B22D 25/02 164/98
5,776,010 A * 7/1998 Helmstetter ..... A63B 53/04 473/334
5,833,551 A * 11/1998 Vincent ..... A63B 53/04 473/350
6,126,556 A * 10/2000 Hsieh ..... A63B 53/0487 473/256
6,258,183 B1 * 7/2001 Onuki ..... A63B 53/04 148/403
6,406,382 B1 * 6/2002 Deshmukh ..... A63B 53/0466 473/349
7,086,964 B2 * 8/2006 Chen ..... B23K 1/0008 473/350
7,578,754 B2 * 8/2009 Nakamura ..... A63B 53/047 473/342
8,043,167 B2 * 10/2011 Boyd ..... A63B 53/04 473/334
8,133,129 B2 * 3/2012 Boyd ..... A63B 53/047 473/288
8,206,237 B2 * 6/2012 Gilbert ..... A63B 53/0475 473/309
8,911,304 B1 * 12/2014 Dawson ..... A63B 60/02 473/350
8,920,259 B2 * 12/2014 Takechi ..... A63B 53/047 473/329
9,061,186 B2 * 6/2015 Larson ..... A63B 53/047
9,345,937 B1 * 5/2016 Ivanova ..... A63B 53/0475
9,381,408 B2 * 7/2016 Kuhar ..... A63B 53/047
10,086,244 B2 * 10/2018 Morin ..... A63B 53/047
10,661,128 B2 * 5/2020 Ripp ..... A63B 53/047
2002/0082108 A1 * 6/2002 Peters ..... A63B 53/04 473/291
2003/0013545 A1 * 1/2003 Vincent ..... A63B 60/02 473/332
2005/0277485 A1 * 12/2005 Hou ..... A63B 60/54 473/332
2006/0089206 A1 * 4/2006 Lo ..... A63B 53/04 473/334
2006/0172822 A1 * 8/2006 Liang ..... A63B 53/047 473/350
2008/0318706 A1 * 12/2008 Larson ..... A63B 53/04 473/334
2009/0137339 A1 * 5/2009 Nakano ..... A63B 53/0475 473/350
2009/0305815 A1 * 12/2009 Hirano ..... A63B 53/047 473/350
2012/0071259 A1 * 3/2012 Clausen ..... A63B 60/54 473/290
2012/0071270 A1 * 3/2012 Nakano ..... A63B 60/54 473/350
2013/0303302 A1 * 11/2013 Jorgensen ..... A63B 60/00 473/328
2013/0344988 A1 * 12/2013 Hettinger ..... A63B 60/00 473/349
2015/0190686 A1 * 7/2015 Li ..... B22C 9/04 164/35
2016/0243413 A1 * 8/2016 Ritchie ..... A63B 53/047
2018/0001157 A1 * 1/2018 Abe ..... A63B 60/02

FOREIGN PATENT DOCUMENTS

CN 200963485 Y 10/2007
CN 108273248 A 7/2018
CN 108905114 A 11/2018
CN 208756910 U 4/2019
EP 0895822 A1 2/1999
JP 2003093558 A 4/2003

* cited by examiner

AMORPHOUS ALLOY GOLF CLUB HEAD AND MANUFACTURING METHOD THEREOF

CROSS REFERENCE TO THE RELATED APPLICATIONS

This application is the national phase entry of International Application PCT/CN2019/101570, filed on Aug. 20, 2019, which is based upon and claims priority to Chinese Patent Application No. 201810980343.7 filed on Aug. 27, 2018, and Chinese Patent Application No. 201910720914.8 filed on Aug. 6, 2019, the entire contents of which are incorporated herein by reference.

TECHNICAL FIELD

The present invention discloses an amorphous alloy golf club head, and in particular, to an amorphous alloy golf club head made of an amorphous alloy material.

BACKGROUND

Golf is a recreational sport that has evolved over centuries. As an important part of a golf club, a golf club head may be deformed to some extent when hitting a golf ball. In order to achieve a high ball velocity and a long flight distance during hitting, and to prevent the club head from breaking, the club head material should have a certain toughness and hardness, high elastic modulus, and low internal friction.

With the continuous improvement of functional requirements, the materials of golf club heads have gradually evolved from the earliest hickory wood and persimmon wood to materials such as titanium alloys, stainless steels and aluminum alloys that are commonly used now. The hitting surfaces made of titanium alloy, stainless steel, and aluminum alloy have respective advantages, but these materials cannot combine the higher toughness and hardness, higher elastic limit, and low energy consumption required by the materials of golf club heads.

Amorphous alloy is obtained by rapidly cooling an alloy melt, where there is no time to nucleate and grow to form a long-range disordered and short-range ordered structure. Due to its unique disordered structure, the amorphous alloy does not have defects such as dislocations, vacancies, grain boundaries, and stacking faults in the crystalline alloy, so that the amorphous alloy has high tensile strength, elastic limit, and impact fracture properties as well as good corrosion resistance, and has very good energy transfer performance.

The energy transfer efficiencies of golf club heads made of stainless steel and titanium alloy are 60% and 70%, respectively. In contrast, because the bulk amorphous alloy does not have crystal defects such as grain boundaries and dislocations, the club heads made of the bulk amorphous alloy can transfer 99% energy. However, the preparation of amorphous alloy materials requires an extremely fast cooling rate, which limits the size of amorphous alloy products.

The iron golf club head is partially thicker in size, the cooling rate is slower during casting, and it is easy to form an amorphous and crystalline mixture, which greatly reduces the overall performance of the hitting surface.

At present, amorphous alloys are mostly applied to the hitting surfaces of golf club heads, that is, amorphous alloy sheets are embedded on the club head as a hitting surface by means of gluing, welding or interference fit. However, the fitting methods are at the cost of the elasticity and strength of the material.

SUMMARY

In order to solve the shortcomings of the prior art, the present invention provides an amorphous alloy golf club head. The amorphous alloy golf club head is integrally casted by embedding a metal block in a mold and then coating the metal block with an amorphous alloy material. Thus, the technical problem that an amorphous and crystalline mixture would be easily formed in the existing amorphous alloy golf club head made of an amorphous alloy is solved.

To achieve the foregoing objective, the present invention adopts the following technical solution;

an amorphous alloy golf club head, comprising: a neck configured for combination with a club;

a hitting panel connected to the bottom of the neck;

a peripheral wall located on a rear surface of the hitting panel, the peripheral wall forming a rear concave cavity with the hitting panel, wherein the hitting panel and the peripheral wall are integrally casted from an amorphous metal material;

a cushion block embedded in the peripheral wall to reduce the casting thickness of the peripheral wall, and provided with a plurality of pillars thereon, wherein one end of each pillar is fixedly connected to the cushion block body, and the other end of the pillar has an exposed surface or exposed section not covered by the peripheral wall; and an adjusting member matingly connected to the pillar and configured to adjust the tightness between the cushion block and the peripheral wall.

The hitting panel is an equal-thickness panel having a thickness of 1.5 mm to 5 mm. The peripheral wall comprises a thin-walled portion surrounding an upper edge and a side edge of the rear surface of the hitting panel, and a thick-walled portion surrounding the bottom of the rear surface of the hitting panel, wherein the wall thickness of the thin-walled portion is 1.5 mm to 6 mm, and the wall thickness of the thick-walled portion is 10 mm to 30 mm.

The pillar protrudes from the peripheral wall and has an exposed section. An external thread is disposed on an outer wall of the exposed section. The adjusting member is a nut. The nut is matingly connected to the external thread of the exposed section.

The pillar is disposed in the peripheral wall and has an exposed surface. An internal thread is disposed in the pillar. The adjusting member is a bolt. The bolt is matingly connected to the internal thread on the pillar.

The cushion block is any one of an aluminum alloy, a titanium alloy, a stainless steel, and a copper alloy.

An amorphous alloy golf club head, comprising:

a neck configured for combination with a club;

a hitting part connected to the bottom of the neck;

wherein the hitting part is integrally casted from an amorphous metal material, and an integrally casted amorphous golf club head is obtained by embedding a metal block in a mold, and then injecting an alloy melt into the mold to coat the metal block, and rapidly cooling the alloy melt to obtain the integrally casted amorphous alloy golf club head;

the metal block is used to reduce the thickness of the casted amorphous alloy material;

the hitting portion comprises:

a hitting panel connected to the bottom of the neck;

a peripheral wall located on a rear surface of the hitting panel, the peripheral wall forming a rear concave cavity with the hitting panel;

a metal block embedded in the peripheral wall to reduce the casting thickness of the peripheral wall, and provided with a plurality of pillars thereon, wherein one end of each pillar is fixedly connected to the metal block body, and the other end of the pillar has an exposed surface or exposed section not covered by the peripheral wall; and an adjusting member matingly connected to the pillar and configured to adjust the tightness between the metal block and the peripheral wall.

The hitting panel is an equal-thickness panel having a thickness of 1.5 mm to 5 mm;

the peripheral wall comprises a thin-walled portion surrounding an upper edge and a side edge of the rear surface of the hitting panel, and a thick-walled portion surrounding the bottom of the rear surface of the hitting panel, wherein the wall thickness of the thin-walled portion is 1.5 mm to 6 mm; and the wall thickness of the thick-walled portion is 10 mm to 30 mm.

The pillar protrudes from the peripheral wall and has an exposed section. An external thread is disposed on an outer wall of the exposed section. The adjusting member is a nut. The nut is matingly connected to the external thread of the exposed section.

The pillar is disposed in the peripheral wall and has an exposed surface. An internal thread is disposed in the pillar. The adjusting member is a bolt. The bolt is matingly connected to the internal thread on the pillar.

A method for manufacturing the amorphous alloy golf club head, comprising the following steps:

step 1: connecting an embedded metal block to a mold core by means of a pillar on the metal block, adjusting the distance of the tail end of the pillar embedded in the mold core to ensure that the metal block can be accurately positioned when mold closing is performed, so that the thickness of the amorphous alloy material that is coated on the outside of the metal block is uniform after die casting; and step 2: making an alloy melt obtained through induction melting enter a sprue bushing on a fixed mold plate under pressure, entering a cavity through the action of a sprue spreader, and finally rapidly cooling to obtain an integrally casted amorphous alloy club head product.

The present invention has the following advantageous effects.

First, the present invention adopts an integrally casted amorphous alloy golf club head, which has high tensile strength, elastic limit, and impact fracture properties as well as good corrosion resistance compared with the currently common golf club heads made of crystalline metals such as titanium alloy, aluminum alloy and stainless steel, and has very good energy transfer performance.

Second, in order to avoid generating an amorphous and crystalline mixture in the preparation of amorphous alloy golf club heads due to the slow cooling rate caused by the thick size, the present invention embeds a cushion block with a pillar in the cavity of the club head, so as to reduce the casting thickness of the thicker part of the club head, greatly improving its amorphous forming ability, and ensuring the quality of the product after casting.

Third, in order to avoid the occurrence of loosening of the embedded cushion block during the use of the amorphous alloy golf club head, the present invention provides internal or external threads for the pillar of the embedded cushion block, and adjusts the tightness of the embedded cushion block and the outer amorphous alloy by adding bolts or nuts.

Fourth, the embedded metal block of the present invention solves the limitation of the amorphous forming ability and the limited size on the production of the amorphous alloy golf club head by the integral casting process.

Fifth, the embedded metal block of the present invention solves the problem of reducing the high elasticity and high strength and other properties of the amorphous alloy material caused by embedding an amorphous alloy sheet on the club head as a club head hitting surface by means of gluing, welding or interference fit.

Sixth, the type, shape, and size of the embedded metal of the present invention can vary with the design of the weight, shape, and size of the bulb head, without limitation.

Seventh, the embedded metal block of the present invention ensures the uniformity of the thickness of the coating amorphous material by using a pillar as a contact point with the inner wall of a mold cavity, fixing the position of the metal block in the mold cavity, and adjusting the size of the pillar embedded in the mold core.

BRIEF DESCRIPTION OF THE DRAWINGS

In FIG. 1, the features are as follows: neck 1, hitting panel 2, thick-walled portion 3, thin-walled portion 4, and pillar 5.

In FIG. 2, the features are as follows: bolt 14.

In FIG. 3, the features are as follows: nut 15.

In FIG. 5, the features are as follows: fixed mold plate 6, moving mold plate 7, fixed mold core 8, moving mold core 9, sprue bushing 10, cavity 11, sprue spreader 12.

DETAILED DESCRIPTION OF THE EMBODIMENTS

The technical solution of an amorphous alloy golf club head according to the present invention will be further described below in detail with reference to the accompanying drawings and specific embodiments.

Figure 1:
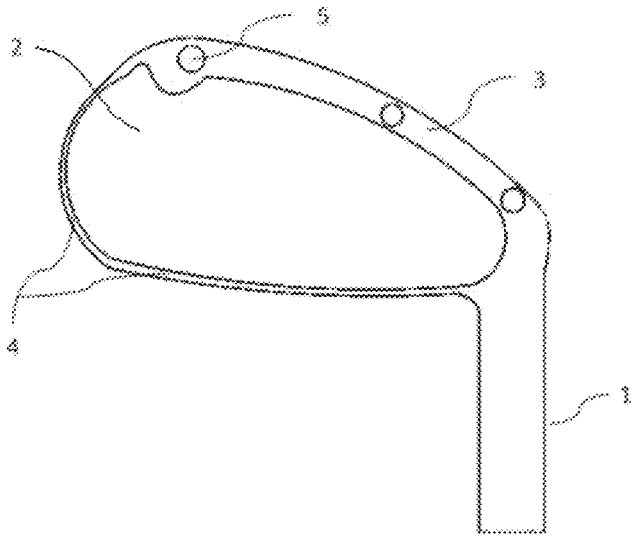
FIG. 1 is a schematic structural diagram of an amorphous alloy golf club head according to the present invention.
Figure 2:
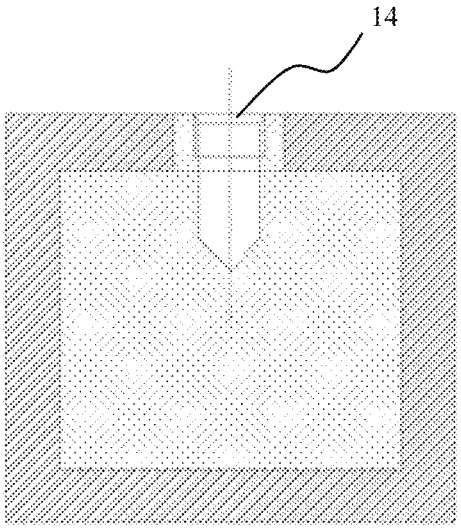
FIG. 2 is a cross-sectional view when an internal thread is disposed on a cushion block.

As shown in FIGS. 1 and 2, the present invention provides an amorphous alloy golf club head integrally casted from an amorphous metal material, comprising:

a neck configured for combination with a club;

a hitting panel connected to the bottom of the neck;

a peripheral wall located on a rear surface of the hitting panel, the peripheral wall forming a rear concave cavity with the hitting panel, wherein the peripheral wall comprises a thin-walled portion surrounding an upper edge and a side edge of the rear surface of the hitting panel, and a thick-walled portion surrounding the bottom of the rear surface of the hitting panel;

a cushion block embedded in the thick-walled portion to reduce the casting thickness of the thick-walled portion, and provided with a plurality of pillars thereon, wherein one end of each pillar is fixedly connected to the cushion block body, and the other end of the pillar has an exposed surface or exposed section not covered by the peripheral wall; and an adjusting member matingly connected to the pillar and configured to adjust the tightness between the embedded cushion block and the peripheral wall.

In order to reduce the casting thickness of the thick-walled portion and reduce the risk of crystallization in preparation of the large-size amorphous alloy golf club heads due to the slower cooling rate, the present invention embeds the cushion block with pillars in the cavity.

As a preferred embodiment of the technical solution of the present invention, the wall thickness of the thick-walled portion is 10 mm to 30 mm.

As a preferred embodiment of the technical solution of the present invention, the hitting panel is an equal-thickness panel having a thickness of 1.5 mm to 5 mm.

As a preferred embodiment of the technical solution of the present invention, the wall thickness of the thin-walled portion is 1.5 mm to 6 mm.

Embodiment 1

Figure 4:
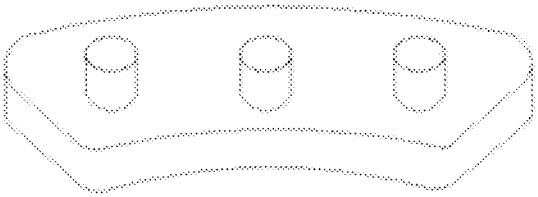
FIG. 4 is a schematic structural diagram of the cushion block in Embodiment 2.
Figure 5:
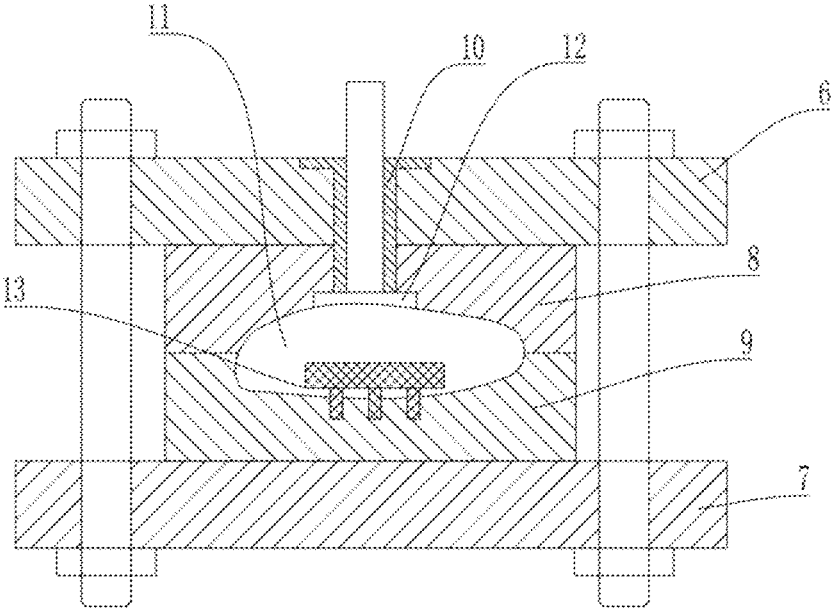
FIG. 5 is a schematic structural diagram of a die-casting mold of an amorphous alloy golf club head according to the present invention.
Figure 6:
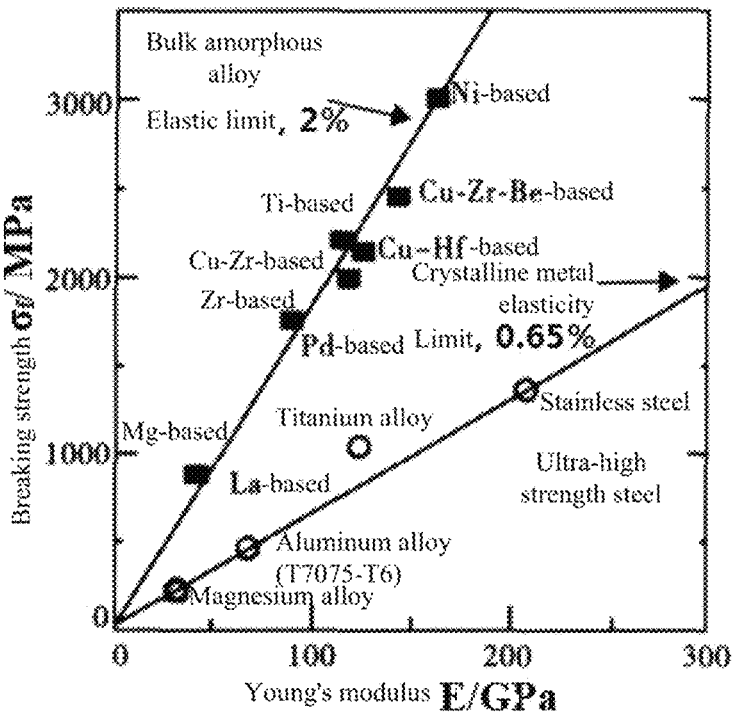
FIG. 6 is a comparison diagram of breaking strength and Young's modulus of a common alloy and an amorphous alloy.

As shown in FIG. 4, the present invention provides an amorphous alloy golf club head integrally casted from an amorphous metal material, comprising:

a neck configured for combination with a club;

a hitting panel connected to the bottom of the neck;

a peripheral wall located on a rear surface of the hitting panel, the peripheral wall forming a rear concave cavity with the hitting panel, wherein the peripheral wall comprises a thin-walled portion surrounding an upper edge and a side edge of the rear surface of the hitting panel, and a thick-walled portion surrounding the bottom of the rear surface of the hitting panel; and a cushion block embedded in the thick-walled portion to reduce the casting thickness of the thick-walled portion, and provided with three pillars thereon, wherein one end of each pillar is fixedly connected to the cushion block body, and the other end of the pillar has an exposed surface not covered by the peripheral wall. The pillar is disposed inside the thick-walled portion and has an exposed surface. The pillar has an internal thread. As shown in FIG. 2, the adjusting member is a bolt 14. The bolt 14 is matingly connected to the internal thread on the pillar by means of the exposed surface. Providing a bolt 14 on the pillar subjected to internal thread treatment can also adjust the tightness of the embedded cushion block and the outer amorphous alloy.

Embodiment 2

Figure 3:
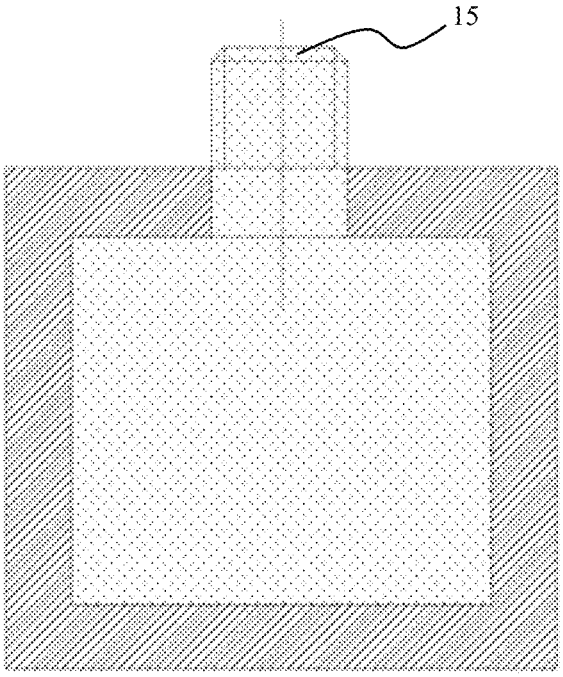
FIG. 3 is a cross-sectional view when an external thread is disposed on the cushion block.

As shown in FIG. 3, the present invention provides an amorphous alloy golf club head integrally casted from an amorphous metal material, comprising:

a neck configured for combination with a club;

a hitting panel connected to the bottom of the neck;

a peripheral wall located on a rear surface of the hitting panel, the peripheral wall forming a rear concave cavity with the hitting panel, wherein the peripheral wall comprises a thin-walled portion surrounding an upper edge and a side edge of the rear surface of the hitting panel, and a thick-walled portion surrounding the bottom of the rear surface of the hitting panel; and a cushion block embedded in the thick-walled portion to reduce the casting thickness of the thick-walled portion, and provided with three metal pillars thereon, wherein one end of the metal pillar is fixedly connected to the cushion block body, and the other end of the metal pillar has an exposed section. An external thread is disposed on an outer wall of the exposed section. As shown in FIG. 3, the adjusting member is a nut 15, and the nut 15 is matingly connected to the external thread. Providing a nut 15 on the metal pillar subjected to external thread treatment can adjust the tightness of the embedded cushion block and the outer amorphous alloy.

Further, the counterweight of the amorphous alloy golf club head of the present invention can be realized by changing the bolt 14 or nut 15 connected to the pillar, or by embedding cushion blocks with different types of materials. Cushion blocks of different weights can be obtained by selecting and replacing the cushion blocks of different materials, so that the counterweight can be performed according to the counterweight requirements. The cushion block can be made of a metal material such as an aluminum alloy, a titanium alloy, a stainless steel, and a copper alloy.

The die-casting mold of the amorphous alloy golf club head according to the present invention is composed of a moving mold plate, a moving mold core, a fixed mold core, and a fixed mold plate. The moving mold core and the fixed mold core form a cavity when mold closing is performed on the moving mold plate and the fixed mold plate.

The metal block is embedded in the mold core by means of the pillar to ensure that the embedded metal block can be accurately positioned when mold closing is performed.

A sprue bushing and a sprue spreader are disposed on the fixed mold plate, and are connected to a die-casting machine and the cavity, respectively.

The alloy melt obtained through induction melting enters the sprue bushing under pressure, and enters the cavity through the action of the sprue spreader to obtain the club head product.

Figure 7:
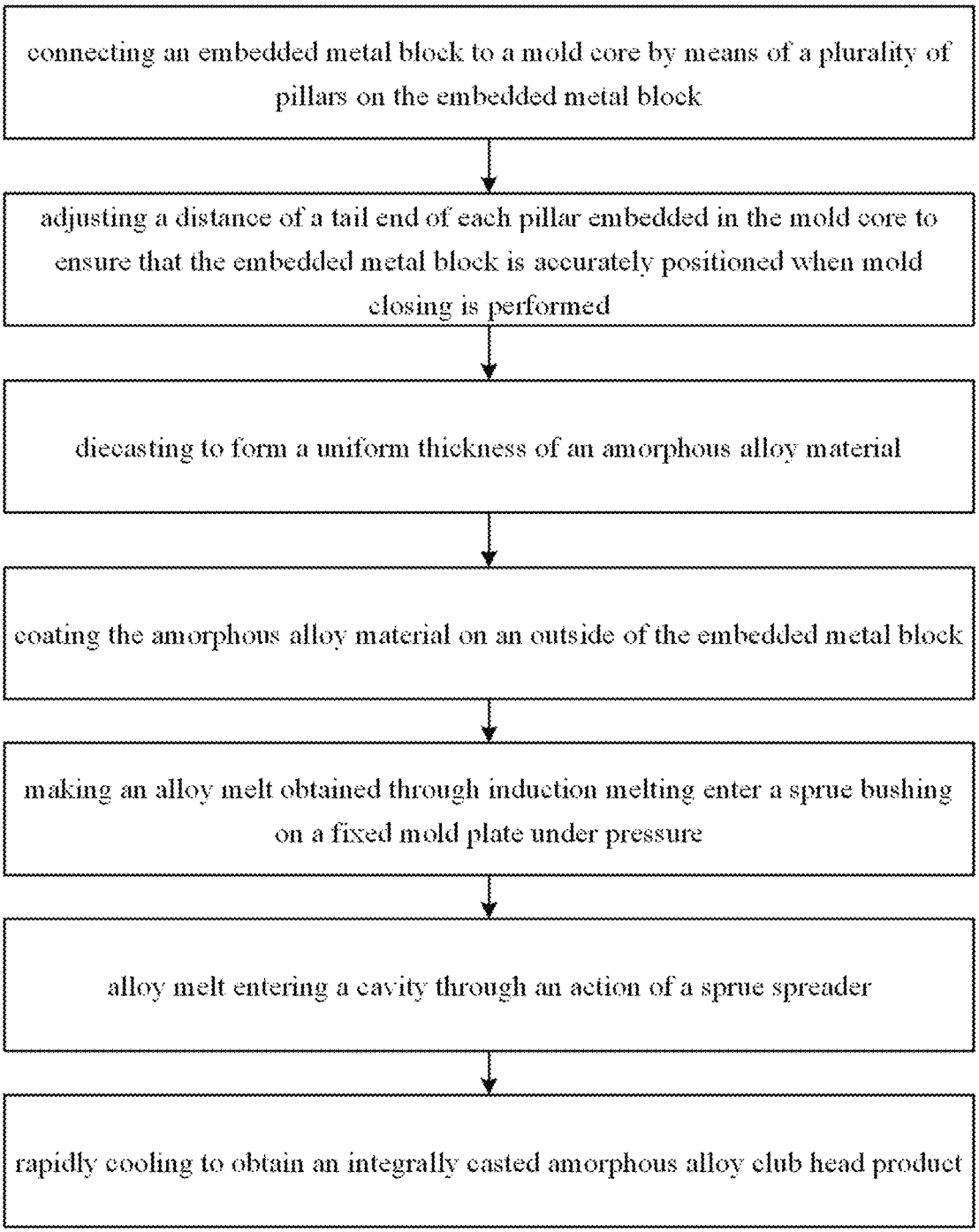
FIG. 7 is a method for manufacturing the amorphous alloy golf club head.

As shown in FIG. 7, a method for manufacturing the amorphous alloy golf club head, comprises the following steps:

step 1: connecting an embedded metal block to a mold core by means of a pillar on the metal block, adjusting the distance of the tail end of the pillar embedded in the mold core to ensure that the metal block can be accurately positioned when mold closing is performed, so that the thickness of the amorphous alloy material that is coated on the outside of the metal block is uniform after die casting; and step 2: making an alloy melt obtained through induction melting enter a sprue bushing on a fixed mold plate under pressure, entering a cavity through the action of a sprue spreader, and finally rapidly cooling to obtain an integrally casted amorphous alloy club head product.

Finally, it should be noted that the embodiments above are only intended to illustrate the technical solution of the present invention, and are not limiting. Although the present invention is described in detail with reference to preferred embodiments, those skilled in the art should understand that modifications to specific embodiments of the present invention or equivalent replacement of some technical features can still be made, and these modifications should be covered by the scope of the technical solution claimed by the present invention, without departing from the spirit of the technical solution of the present invention.

What is claimed is:

1. An amorphous alloy golf club head, comprising:

a neck configured for combination with a club;

a hitting panel connected to a bottom of the neck;

a peripheral wall, wherein the peripheral wall is located on a rear surface of the hitting panel, the peripheral wall forms a rear concave cavity with the hitting panel, and the hitting panel and the peripheral wall are integrally casted from an amorphous metal material;

a cushion block, wherein the cushion block is embedded in the peripheral wall, the cushion block is configured to reduce a casting thickness of the peripheral wall, a plurality of pillars are provided on the cushion block, a first end of each pillar of the plurality of pillars is fixedly connected to a cushion block body, a second end of the each said pillar of the plurality of pillars has an exposed surface or exposed section, and the exposed surface or exposed section is not covered by the peripheral wall; and an adjusting member, wherein the adjusting member is matingly connected to each said pillar of the plurality of pillars and the adjusting member is configured to adjust a tightness between the cushion block and the peripheral wall.

2. The amorphous alloy golf club head according to claim 1, wherein the hitting panel is an equal-thickness panel having a thickness of 1.5 mm to 5 mm; and the peripheral wall comprises a thin-walled portion surrounding an upper edge and a side edge of the rear surface of the hitting panel, and a thick-walled portion surrounding a bottom of the rear surface of the hitting panel, wherein a wall thickness of the thin-walled portion is 1.5 mm to 6 mm, and a wall thickness of the thick-walled portion is 10 mm to 30 mm.

3. The amorphous alloy golf club head according to claim 1, wherein each said pillar of the plurality of pillars protrudes from the peripheral wall and has the exposed section; an external thread is disposed on an outer wall of the exposed section; the adjusting member is a nut; and the nut is matingly connected to the external thread of the exposed section.

4. The amorphous alloy golf club head according to claim 1, wherein each said pillar of the plurality of pillars is disposed in the peripheral wall and has an exposed surface; an internal thread is disposed in each said pillar of the plurality of pillars; the adjusting member is a bolt; and the bolt is matingly connected to the internal thread on each said pillar of the plurality of pillars.

5. The amorphous alloy golf club head according to claim 1, wherein the cushion block is selected from the group of an aluminum alloy, a titanium alloy, a stainless steel, and a copper alloy.

6. A method for manufacturing the amorphous alloy golf club head according to claim 1, comprising:

connecting, using the plurality of pillars, an embedded metal block to a mold core, adjusting a distance of each said pillar of the plurality of pillars embedded in the mold core to ensure that the embedded metal block is accurately positioned when mold closing is performed, wherein a thickness of an amorphous alloy material is uniform after die casting, and the amorphous alloy material is coated on an outside of the embedded metal block; and making an alloy melt obtained through induction melting enter a sprue bushing on a fixed mold plate under pressure, entering a cavity through an action of a sprue spreader, and rapidly cooling to obtain an integrally casted amorphous alloy club head product.

7. An amorphous alloy golf club head, comprising:

a neck, configured for combination with a club;

a hitting part, wherein the hitting part is connected to a bottom of the neck, the hitting part is integrally casted from an amorphous metal material, and an integrally casted amorphous golf club head is obtained by embedding a metal block in a mold, injecting an alloy melt into the mold to coat the metal block, and rapidly cooling the alloy melt to obtain the integrally casted amorphous alloy golf club head;

the metal block is configured to reduce a thickness of a casted amorphous alloy material;

the hitting part comprises:

a hitting panel connected to the bottom of the neck;

a peripheral wall, wherein the peripheral wall is located on a rear surface of the hitting panel, and the peripheral wall forms a rear concave cavity with the hitting panel;

wherein the metal block is embedded in the peripheral wall, the metal block is configured to reduce a casting thickness of the peripheral wall, a plurality of pillars are provided on the metal block, a first end of each pillar of the plurality of pillars is fixedly connected to a body of the metal block, a second end of each said pillar of the plurality of pillars has an exposed surface or exposed section, and the exposed surface or exposed section is not covered by the peripheral wall; and an adjusting member, wherein the adjusting member is matingly connected to each said pillar of the plurality of pillars and the adjusting member is configured to adjust a tightness between the metal block and the peripheral wall.

8. The amorphous alloy golf club head according to claim 7, wherein the hitting panel is an equal-thickness panel having a thickness of 1.5 mm to 5 mm;

the peripheral wall comprises a thin-walled portion surrounding an upper edge and a side edge of the rear surface of the hitting panel, and a thick-walled portion surrounding a bottom of the rear surface of the hitting panel, wherein a wall thickness of the thin-walled portion is 1.5 mm to 6 mm; and a wall thickness of the thick-walled portion is 10 mm to 30 mm.

9. The amorphous alloy golf club head according to claim 7, wherein each said pillar of the plurality of pillars protrudes from the peripheral wall and has the exposed section; an external thread is disposed on an outer wall of the exposed section; the adjusting member is a nut; and the nut is matingly connected to the external thread of the exposed section.

10. The amorphous alloy golf club head according to claim 9, wherein each said pillar of the plurality of pillars is disposed in the peripheral wall and has an exposed surface; an internal thread is disposed in each said pillar of the plurality of pillars; the adjusting member is a bolt; and the bolt is matingly connected to the internal thread on each said pillar of the plurality of pillars.

11. The amorphous alloy golf club head according to claim 7, wherein each said pillar of the plurality of pillars is disposed in the peripheral wall and has an exposed surface; an internal thread is disposed in each said pillar of the plurality of pillars; the adjusting member is a bolt; and the bolt is matingly connected to the internal thread on each said pillar of the plurality of pillars.

12. The amorphous alloy golf club head according to claim 11, wherein the hitting panel is an equal-thickness panel having a thickness of 1.5 mm to 5 mm; and the peripheral wall comprises a thin-walled portion surrounding an upper edge and a side edge of the rear surface of the hitting panel, and a thick-walled portion surrounding a bottom of the rear surface of the hitting panel, wherein a wall thickness of the thin-walled portion is 1.5 mm to 6 mm, and a wall thickness of the thick-walled portion is 10 mm to 30 mm.

13. The amorphous alloy golf club head according to claim 11, wherein the exposed surface of each said pillar of the plurality of pillars is formed on the exposed section, and wherein the exposed surface of each said pillar of the plurality of pillars disposed in the peripheral wall protrudes from the peripheral wall; an external thread is disposed on an outer wall of the exposed section; the adjusting member is a nut; and the nut is matingly connected to the external thread of the exposed section.

14. The amorphous alloy golf club head according to claim 11, wherein the metal block is selected from the group of an aluminum alloy, a titanium alloy, a stainless steel, and a copper alloy.

* * * * *